US010570813B2

(12) United States Patent
Tiramani et al.

(10) Patent No.: US 10,570,813 B2
(45) Date of Patent: Feb. 25, 2020

(54) TURBOCHARGER EXHAUST MANIFOLD WITH TURBINE BYPASS OUTLET

(71) Applicant: 500 Group, Inc., Las Vegas, NV (US)

(72) Inventors: Paolo Tiramani, Las Vegas, NV (US); Kyle Denman, North Las Vegas, NV (US)

(73) Assignee: 500 Group, Inc., Las Vegas, NV (US)

( * ) Notice: Subject to any disclaimer, the term of this patent is extended or adjusted under 35 U.S.C. 154(b) by 0 days.

(21) Appl. No.: 16/168,999

(22) Filed: Oct. 24, 2018

(65) Prior Publication Data

US 2019/0128175 A1 May 2, 2019

Related U.S. Application Data

(60) Provisional application No. 62/697,072, filed on Jul. 12, 2018, provisional application No. 62/678,460,
(Continued)

(51) Int. Cl.
*F02B 37/18* (2006.01)
*F01N 13/10* (2010.01)
(Continued)

(52) U.S. Cl.
CPC ..... *F02B 37/183* (2013.01); *F01N 13/10* (2013.01); *F01N 13/1805* (2013.01); *F02B 75/22* (2013.01)

(58) Field of Classification Search
CPC .... F02B 37/183; F02B 75/22; F01N 13/1805; F01N 13/10
(Continued)

(56) References Cited

U.S. PATENT DOCUMENTS 4,924,967 A 5/1990 Ike et al.
5,689,954 A 11/1997 Blocker et al.
(Continued)

FOREIGN PATENT DOCUMENTS

CN 104279042 A 1/2015
WO 2016/195573 A1 12/2016

OTHER PUBLICATIONS

International Search Report and Written Opinion of the International Searching Authority in PCT/US2018/057233, dated Jan. 4, 2019.
(Continued)

*Primary Examiner* — Hoang M Nguyen
(74) *Attorney, Agent, or Firm* — McCarter & English, LLP

(57) ABSTRACT

An exhaust manifold for an internal combustion piston engine having a first row of at least two cylinders inclined relative to a vertical plane and a second row of at least two cylinders inclined relative to the vertical plane, where the two rows of cylinders form a V configuration with the vertical plane being approximately equidistant between the two rows. The exhaust manifold in one aspect comprises plural exhaust stack assemblies for receiving exhaust gas from the first row of cylinders, an elongate manifold plenum having a terminal portion defining an exhaust gas passageway, and an exhaust gas routing circuit joined to the manifold plenum. The routing circuit comprises a turbocharger support column and a bypass pipe. The turbocharger support column is joined at a first junction with the manifold plenum, extends in a generally perpendicular direction from the elongate manifold plenum and terminates in a first exhaust gas outlet adapted for connection to a turbocharger. The bypass pipe is joined at a second junction with the support column and terminates in a second exhaust gas outlet adapted for connection to an exhaust bypass valve.
(Continued)

Each of the plural exhaust stack assemblies comprises a leader pipe and an exhaust connector, where a first end of each leader pipe is joined to a first end of the exhaust connector of the exhaust stack assembly, a second end of each exhaust connector is joined to the manifold plenum, a second end of each leader pipe is joined to a manifold flange, and the manifold flange is adapted for joining to the internal combustion engine to receive exhaust gases from the first row of cylinders of the engine.

25 Claims, 6 Drawing Sheets

Related U.S. Application Data filed on May 31, 2018, provisional application No. 62/616,601, filed on Jan. 12, 2018, provisional application No. 62/598,045, filed on Dec. 13, 2017, provisional application No. 62/577,965, filed on Oct. 27, 2017, provisional application No. 62/577,423, filed on Oct. 26, 2017.

(51) Int. Cl.
*F01N 13/18* (2010.01)
*F02B 75/22* (2006.01)

(58) Field of Classification Search
USPC ..... 60/605.2, 602
See application file for complete search history.

(56) References Cited

U.S. PATENT DOCUMENTS 6,263,672 B1 7/2001 Roby et al.
8,539,768 B2 9/2013 Hayman et al.
9,316,151 B2 4/2016 Keating et al.
10,132,424 B2 11/2018 Graichen et al.
2005/0183414 A1 8/2005 Bien et al.
2011/0123315 A1* 5/2011 Robinson ..... F02B 37/004 415/145
2012/0285427 A1 11/2012 Hayman et al.
2014/0325984 A1* 11/2014 Blythe ..... F02M 26/32 60/605.2
2015/0007563 A1* 1/2015 Wade ..... F02C 6/12 60/605.2
2015/0007800 A1* 1/2015 Wade ..... F02C 6/12 123/568.14
2018/0156164 A1 6/2018 Keating et al.

OTHER PUBLICATIONS

NPL-1 Turbo Tech introductory guide, accessed Dec. 18, 2018. (7 pages).
NPL-2 Turbo Tech advanced guide, accessed Dec. 18, 2018. (8 pages).
NPL-3 Turbo Tech expert guide, accessed Dec. 18, 2018. (12 pages).
NPL-4 http://www.tialsport.com/ website, accessed Dec. 18, 2018.
NPL-5 https://www.holley.com/products/exhaust/headers_and_exhaust_manifolds/, accessed Jan. 8, 2019.
NPL-6 https://www.holley.com/products/exhaust/headers_and_exhaust_manifolds/exhaust_manifolds/parts/8510HKR, accessed Jan. 8, 2019.
NPL-7 http://stratifiedauto.com/blog/adjusting-and-upgrading-your-wastegate-actuator/, accessed Jan. 8, 2019.
NPL-8 International Search Report dated Jan. 17, 2019, in PCT/US2018/057218.
NPL-9 Facebook Post May 7, 2017 <https://www.facebook.com/SupercarSystem/posts/788183328008424:0>.
NPL-10 Facebook Post May 2, 2016 <https://www.facebook.com/SupercarSystem/posts/591367204356705:0>.

* cited by examiner

TURBOCHARGER EXHAUST MANIFOLD WITH TURBINE BYPASS OUTLET

CROSS-REFERENCES TO RELATED APPLICATIONS

This application claims the benefit of U.S. Provisional Application No. 62/577,423, filed Oct. 26, 2017, U.S. Provisional Application No. 62/577,965, filed Oct. 27, 2017, U.S. Provisional Application No. 62/598,045, filed Dec. 13, 2017, U.S. Provisional Application No. 62/616,601 filed Jan. 12, 2018, U.S. Provisional Application No. 62/678,460, filed May 31, 2018, and U.S. Provisional Application No. 62/697,072, filed Jul. 12, 2018.

BACKGROUND OF THE INVENTION

Field of the Invention

This invention relates to systems for routing the exhaust from internal combustion engines.

Description of the Related Art

Eight cylinder internal combustion engines are often designed with a "V-8" configuration; i.e., two banks of four cylinders rotating a common crankshaft, where each bank is inclined so as to form a "V". The exhaust gases from each bank of cylinders may be directed by means of an exhaust manifold for discharge to the atmosphere, either directly or through other components.

The design of the exhaust manifold can impact engine power and efficiency. Further, in the case where turbocharging is employed, there are challenges in exhaust routing from the exhaust manifold to the turbocharger which can deleteriously contribute to turbo lag as well as energy losses due to piping friction.

SUMMARY OF THE INVENTION

The present invention provides a novel exhaust manifold designed to improve engine performance.

In one aspect, the present invention is directed to an exhaust manifold for an internal combustion piston engine having a first row of at least two cylinders inclined relative to a vertical plane and a second row of at least two cylinders inclined relative to the vertical plane, where the two rows of cylinders form a V configuration with the vertical plane being approximately equidistant between the two rows. The exhaust manifold in this aspect comprises plural exhaust stack assemblies for receiving exhaust gas from the first row of cylinders, an elongate manifold plenum having a terminal portion defining an exhaust gas passageway, and an exhaust gas routing circuit joined to the manifold plenum. The routing circuit comprises a turbocharger support column and a bypass pipe. The turbocharger support column is joined at a first junction with the manifold plenum, extends in a generally perpendicular direction from the elongate manifold plenum and terminates in a first exhaust gas outlet adapted for connection to a turbocharger. The bypass pipe is joined at a second junction with the support column and terminates in a second exhaust gas outlet adapted for connection to an exhaust bypass valve. Each of the plural exhaust stack assemblies comprises a leader pipe and an exhaust connector, where a first end of each leader pipe is joined to a first end of the exhaust connector of the exhaust stack assembly, a second end of each exhaust connector is joined to the manifold plenum, a second end of each leader pipe is joined to a manifold flange, and the manifold flange is adapted for joining to the internal combustion engine to receive exhaust gases from the first row of cylinders of the engine.

These and other aspects of the present invention are described in the drawings annexed hereto, and in the description of the preferred embodiments and claims set forth below.

DETAILED DESCRIPTION OF THE PREFERRED EMBODIMENTS

Figure 1:
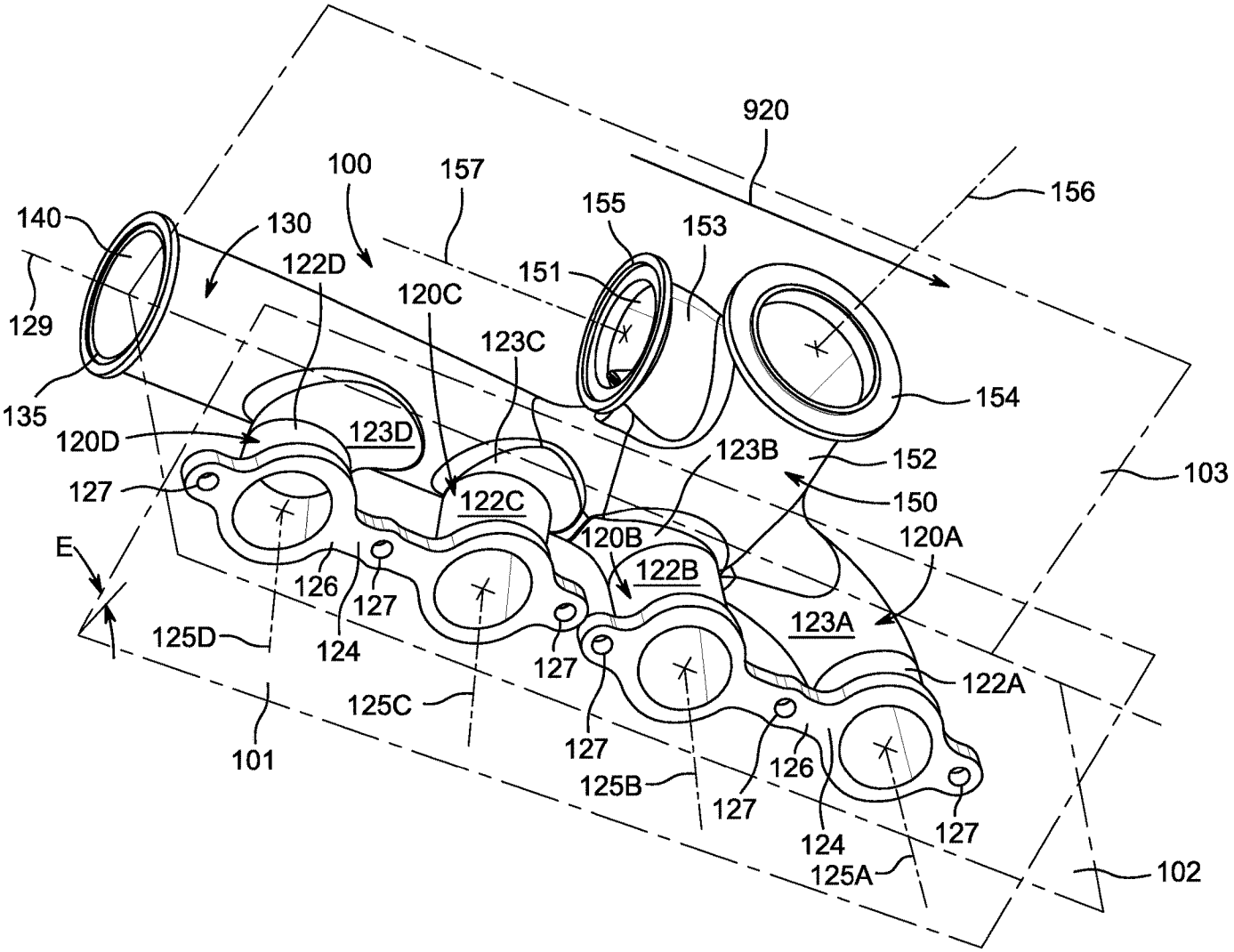
FIG. 1 is a schematic perspective view of the exhaust manifold of the present invention.

FIG. 1 depicts an exhaust manifold 100 designed in accordance with the teachings herein. The direction toward the front of an engine to which exhaust manifold 100 is to be mounted is indicated by arrow 920 in the figures. Accordingly, references in this disclosure to the "forward" or "front" portion of any component or assemblage, and like references, refers to the portion of the component or assemblage oriented most closely to the head of arrow 920, and reference in this disclosure to the "rearward" or "rear" portion of any component or assemblage, and like references, refers to the portion of the component or assemblage oriented least closely to the head of arrow 920. Thus for example, references herein to the "forward" or "rearward" portions of exhaust manifold 100 are made with reference to the orientation of exhaust manifold 100 relative to arrow 920 depicted in FIG. 1; however, this nomenclature is for convenience of reference only, as it should be noted that in one embodiment (described below) exhaust manifold 100 can be mounted in a reversed orientation.

In the embodiment of the present invention illustrated in FIG. 1 and with reference to arrow 920 as shown therein, exhaust manifold 100 is depicted as a left exhaust manifold; i.e., an exhaust manifold for the left cylinder bank (facing forward) of an eight cylinder V-8 engine. In one embodiment of the present invention described below, the design of the exhaust manifold for the right cylinder bank is a mirror of the design of the exhaust manifold for the left cylinder bank. In other embodiments of the present invention described below, the exhaust manifold for the left cylinder bank, denominated 100L in those instances, will differ from the exhaust manifold for the right cylinder bank, denominated 100R in those instances. Where the designs features are the same for the left and right exhaust manifolds, this disclosure will refer to exhaust manifold 100 generically for convenience of reference.

In the case of "V" engines mounted in a conventional manner, the crankshaft centerline 701 (shown end-on in FIG. 3B) is generally oriented in a horizontal plane 106 (shown on edge in FIG. 3B), and the vertical direction generally coincides with a vertical plane 104 (also shown on edge in FIG. 3B) passing through crankshaft centerline 701 and equidistant from the cylinder banks. References to the vertical and horizontal directions in this disclosure are consistent with the foregoing description.

Overall Description

Exhaust manifold 100 includes a manifold plenum 130, for collecting exhaust gases discharged from one or both cylinder banks, depending on the design configuration of the engine exhaust system. In the preferred embodiment, which refers for exemplary purposes to a V-8 engine, exhaust manifold 100 includes four exhaust stack assemblies 120A, 120B, 120C and 120D (collectively referred to as exhaust stack assemblies 120), one for each cylinder in (for purposes of example) the left cylinder bank of a V-8 engine. Exhaust stack assemblies 120 conduct exhaust gases from the left cylinder bank to manifold plenum 130.

Exhaust manifold 100 further includes exhaust gas routing circuit 150 for receiving exhaust gases from manifold plenum 130. Routing circuit 150 in turn includes a turbocharger support column 152 for connection to a turbocharger, and exhaust gas bypass pipe 153, for bypassing the turbocharger turbine. Routing circuit 150 conducts exhaust gases from manifold plenum 130 to a turbocharger inlet via support column 152, and to a bypass valve via exhaust gas bypass pipe 153. In this disclosure, a "turbocharger" is a mechanical unit that contains one or more turbines that are rotated by exhaust gases, which rotation in turn actuates a pump, such as a centrifugal or axial-flow pump, to compress intake air.

Manifold Plenum

Figure 2:
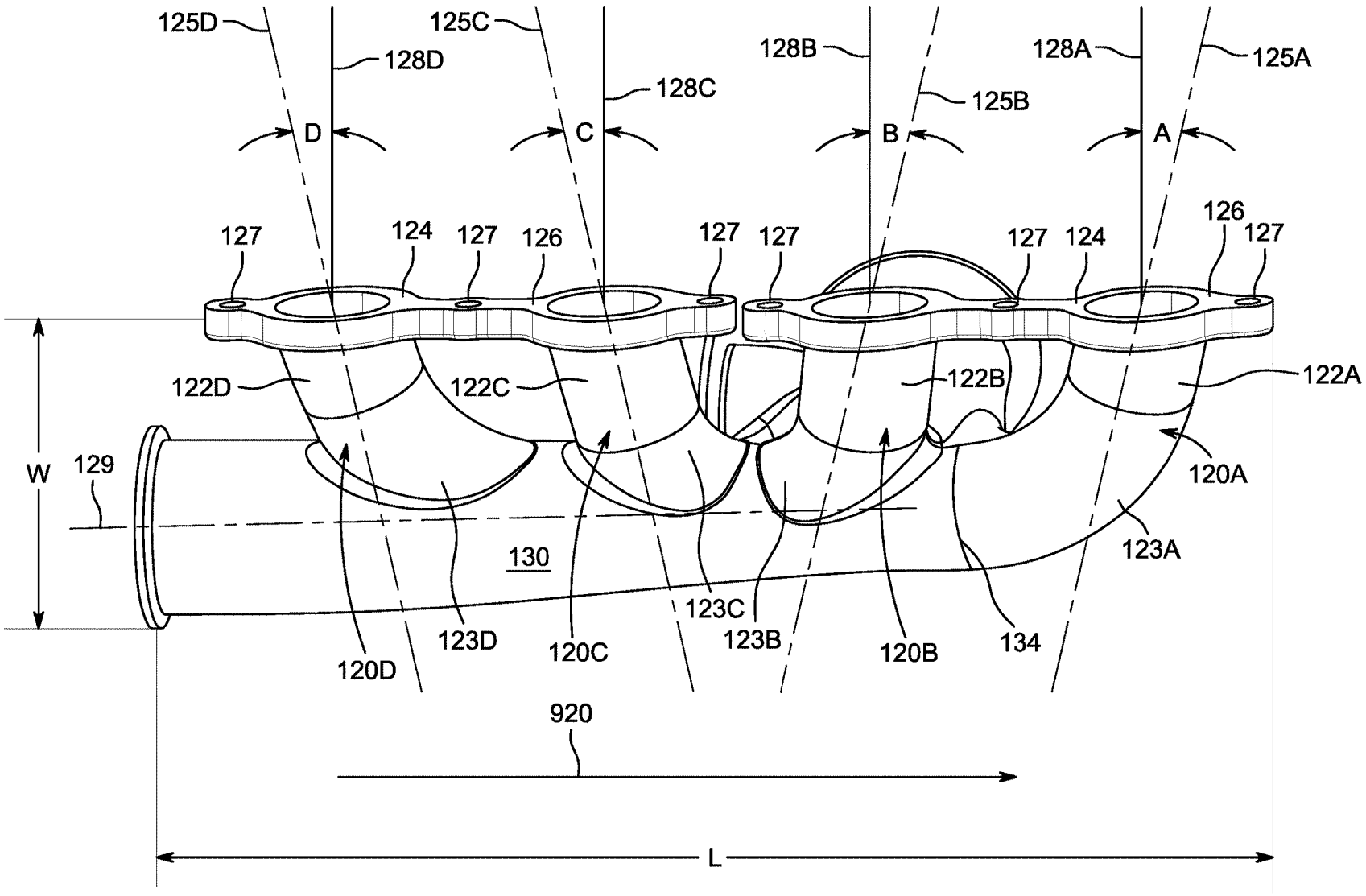
FIG. 2 is a bottom view of the exhaust manifold of the present invention.
Figure 3A:
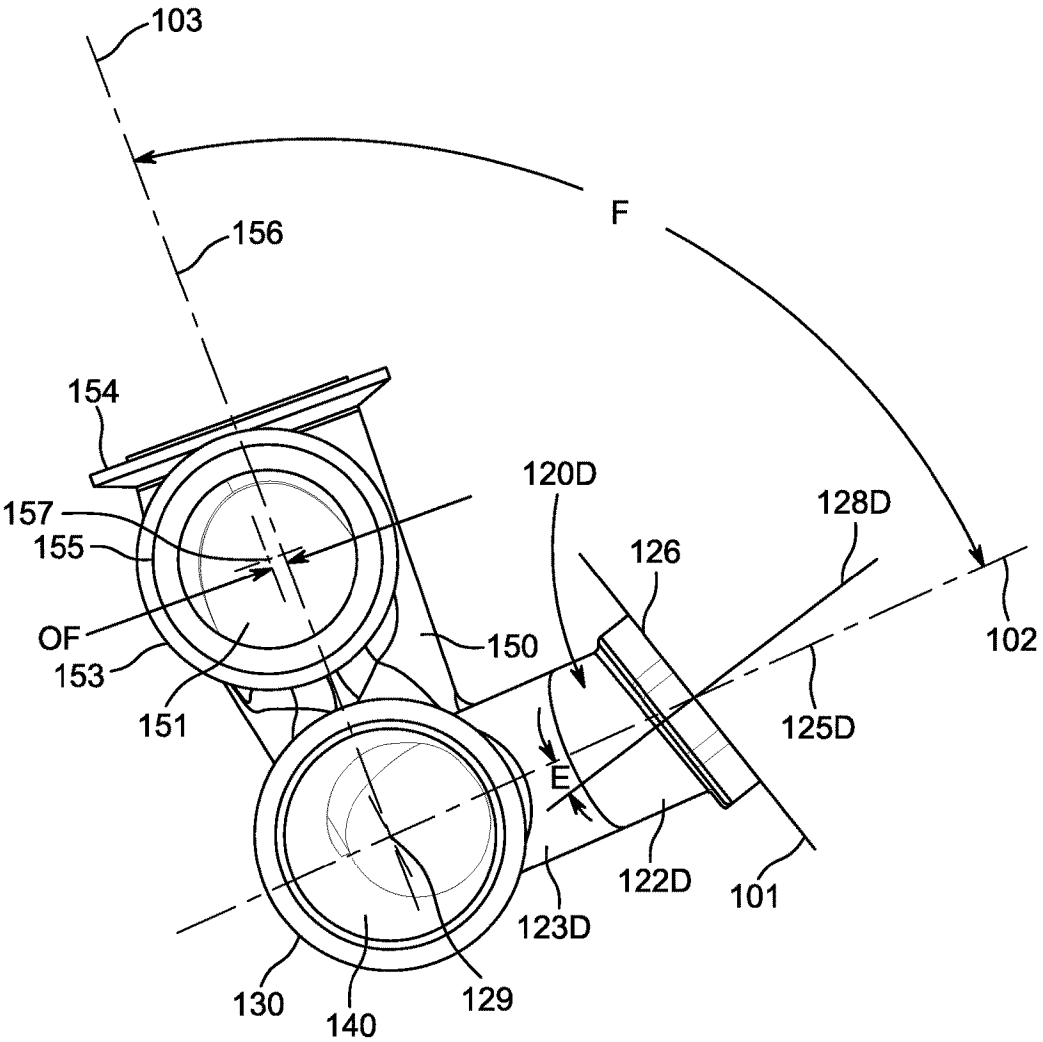
FIG. 3A is a rear view of the exhaust manifold of the present invention.

Manifold plenum 130 has a generally elongate cylindrical shape and a generally cylindrical wall, as shown in FIGS. 1 and 2, and is generally circular in cross-section, as shown for example in FIG. 3A, with an axial centerline 129.

As shown for example in FIG. 2, the diameter of manifold plenum 130 can be varied along its length; i.e., the diameter of manifold plenum 130 preferably increases from the forward end 134 of plenum 130 to the rearward end 135. This growth in diameter yields an expanding cylindrical volume from the forward end 134 to the rearward end 135. It is preferred that the rate of diameter growth of manifold plenum 130 not be constant, but start at zero at forward end 134, then grow at an increasing rate from forward end 134 up to approximately the mid-point between forward end 134 and rearward end 135, then grow at a decreasing rate from that mid-point up to rearward end 135, and again reach a zero growth rate at rear end 135. The result of changing the growth rate in this manner is to generally give an "S" shape to the cylindrical wall of manifold plenum 130 in profile, from forward end 134 to rearward end 135, as shown for example in FIG. 2. Put another way, the profile of manifold plenum 130 comes to be defined by an S-shaped curve rotated about the centerline 129 of plenum 130.

The forward end 134 of manifold plenum 130 (see FIG. 2) is closed off by a first exhaust stack assembly 120A that forms a passageway between the first cylinder of the engine and manifold plenum 130. The rearward end 135 of manifold plenum 130 (FIG. 1) defines an exhaust gas passageway 140 at its rearward terminal portion. In one application of the present invention, in which exhaust manifold 100 shown in FIG. 1 is connected to the one and only turbocharger to be utilized with the engine, exhaust gas passageway 140 can be connected to receive exhaust gases from an exhaust manifold for the right cylinder bank of the engine, to supplement the exhaust gas flow to the turbocharger. In another application of the present invention, in which the exhaust manifold on the right cylinder bank of the engine connects to a second turbocharger, exhaust gas passageway 140 can be connected to its counterpart on the right side of the engine to provide exhaust pulse balancing with the goal of improving engine torque, particularly in the lower range of engine speed.

The length of manifold plenum 130, together with first exhaust stack assembly 120A, largely determines the overall length of exhaust manifold 100, denominated L in FIG. 2. It is preferred that length L be selected so that end 135 of manifold plenum 130 does not extend substantially beyond the engine, and more preferably terminates proximate to the engine, to yield a compact design.

Exhaust Stack Assemblies

Exhaust stack assembly 120A is the forward most exhaust stack assembly, exhaust stack assembly 120B is immediately to the rear of 120A, exhaust stack assembly 120C is immediately to the rear of 120B and exhaust stack assembly 120D is immediately to the rear of 120C, as shown for example in FIGS. 1 and 2.

Exhaust stack assemblies 120 are joined to manifold plenum 130. For the embodiment shown in FIG. 1, exhaust stack assemblies 120 channel exhaust gases from the left cylinder bank into manifold plenum 130, which collects and channels the collected gases to exhaust gas assembly routing circuit 150.

Exhaust stack assemblies 120A, 120B, 120C and 120D each respectively comprises one of a leader pipe 122A, 122B, 122C and 122D (generically referred to as leader pipe 122) and one of exhaust connectors 123A, 123B, 123C and 123D (generically referred to as exhaust connectors 123). The portions of leader pipes 122 proximate the engine are joined to manifold flanges 124. In particular, in the embodiment shown in the figures there are two manifold flanges 124, one of which is joined to the forward two leader pipes 122A and 122B, and the other of which is joined to the rearward two leader pipes 122C and 122D. Alternative designs in accordance with the present invention include individual flanges 124 joining respective individual leader pipes 122, as well as a single flange 124 joining all leader pipes 122.

As shown in FIGS. 1 and 2, each of leader pipe 122A, 122B, 122C and 122D respectively has a centerline 125A, 125B, 125C and 125D (generically referred to as centerline 125). Centerlines 125, as well as the centerlines of exhaust connectors 123, preferably all are oriented to reside in the same geometrical plane 102, which in the preferred embodiment also contains centerline 129 of manifold plenum 130. As discussed further below, plane 102 preferably is approximately horizontal in orientation when exhaust manifold 100 is joined to a conventionally mounted engine (however, centerlines 125 preferably are not parallel, as explained below). Each of leader pipes 122 has a generally circular diameter along the length of its respective centerline 125.

Manifold flanges 124 include engine-side generally planar mating surfaces 126, which form a relatively gas-tight seal when fastened to an engine, and additionally, which define a plurality of apertures 127 that permit exhaust manifold 100 to be fastened (using nuts) to threaded studs extending from the cylinder bank of the engine. The portion of each of stack assemblies 120 distal from the engine is joined to manifold plenum 130, as shown for example in FIGS. 1 and 2.

The engine-side mating surfaces of manifold flanges 124 are oriented parallel to a plane 101, shown in FIG. 1 and edge-on in FIG. 3A. An engine generally will have contact surfaces machined or formed on the engine in a region circumscribing the engine exhaust ports, in order to form a relatively gas-tight seal with appropriate portions of a manifold, which in this embodiment are the engine-side mating surfaces 126 of exhaust manifold 101. For V-8 engines, those contact surfaces generally are inclined from the vertical, for example at an angle V equal to one-half the angle subtended by the cylinder banks; thus, for a V-8 engine, the angle V from the vertical of plane 101 will be for example approximately 22.5°, 30° or 36°.

In the present invention, it is preferred that the centerline 125 of each leader pipe 122, as well as the centerlines of exhaust connectors 123, be inclined upwardly at the same angle E from a line 128 orthogonal to plane 101, as exemplified by FIG. 3A, which depicts this relationship for leader pipe 122D and exhaust connector 123D. In FIG. 3A, the centerlines of exhaust connectors 123, as well as centerlines 125, collectively are contained in plane 102. The magnitude of angle E is determined so that geometrical plane 102 containing centerlines 125, and in turn exhaust stack assemblies 120, are generally horizontal when exhaust manifold 100 is joined to a conventionally mounted engine having an inclined cylinder bank. In some V-8 engine cases, angle E will be approximately the same as angle V, although the ultimate choice for angle E depends on the orientation of the specific engine contact surfaces.

In the embodiment shown in the drawings, and particularly as shown in FIG. 2, it is preferred that centerlines 125 not be parallel to each other, but rather be oriented forwardly or rearwardly so as to direct leader pipes 122 at least in part toward the junction of manifold plenum 130 with exhaust gas routing circuit 150, in order to facilitate the passage of exhaust gases to exhaust gas routing circuit 150 with reduced enthalpy loss, with the goal of improving engine performance. The amount of such forward and rearward orientation depends on the location of routing circuit 150 on manifold plenum 130, and may be limited in magnitude in view of structural considerations.

In particular, relative to flanges 124 and arrow 920 shown in FIG. 2, leader pipes 122A and 122B are oriented in a rearward direction, and leader pipes 122C and 122D are oriented in a forward direction. Referring to FIG. 2, it is preferred for the embodiment depicted in the drawings, which is suitable for an LS3 model 6.2 liter displacement V-8 engine (marketed by General Motors Corp.), that centerline 125A of leader pipe 122A be oriented rearwardly at an angle A equal in magnitude to an angle D at which centerline 125D of leader pipe 122D is oriented forwardly. It is particularly preferred that centerline 125A of leader pipe 122A be oriented rearwardly at an angle A of 15°, and that centerline 125D of leader pipe 122D be oriented forwardly at an angle D of 15°. It is also particularly preferred that centerline 125B of leader pipe 122B be oriented rearwardly at an angle B of 10°, and that centerline 125C of leader pipe 122C be oriented forwardly at an angle C of 10°.

In the embodiment shown in the drawings, the first exhaust connector 123A is a curved pipe of relatively uniform diameter, whereas the diameters of second, third and fourth exhaust connectors 123B, 123C and 123D increase with increasing distance from flanges 124, in order to permit the expansion of the exhaust gases along their length. This increase in diameter is for purposes of reducing cylinder backpressure and improving exhaust gas scavenging during the exhaust cycle. Leader pipes 122 are joined to flange fittings 124 via welding, brazing or by being integrally formed with flange fittings 24. Likewise, exhaust connectors 123A, 123B, 123C and 123D are joined to manifold plenum 30 via welding, brazing or by being integrally formed with manifold plenum 130, and leader pipes 122 are joined to exhaust connectors 123A, 123B, 123C and 23D via welding, brazing or by being integrally formed with connectors 123A, 123B, 123C and 123D The overall width of exhaust manifold 100, denominated W in FIG. 2, is largely determined by the diameter of manifold plenum 30, together with the lengths of exhaust stacks 120 (coinciding with the distance between flanges 124 and manifold plenum 130). It is preferred that length W be as compact as exhaust gas flow, structural and service access considerations will permit, in order to yield a compact design.

Gas Routing Circuit

Figure 4:
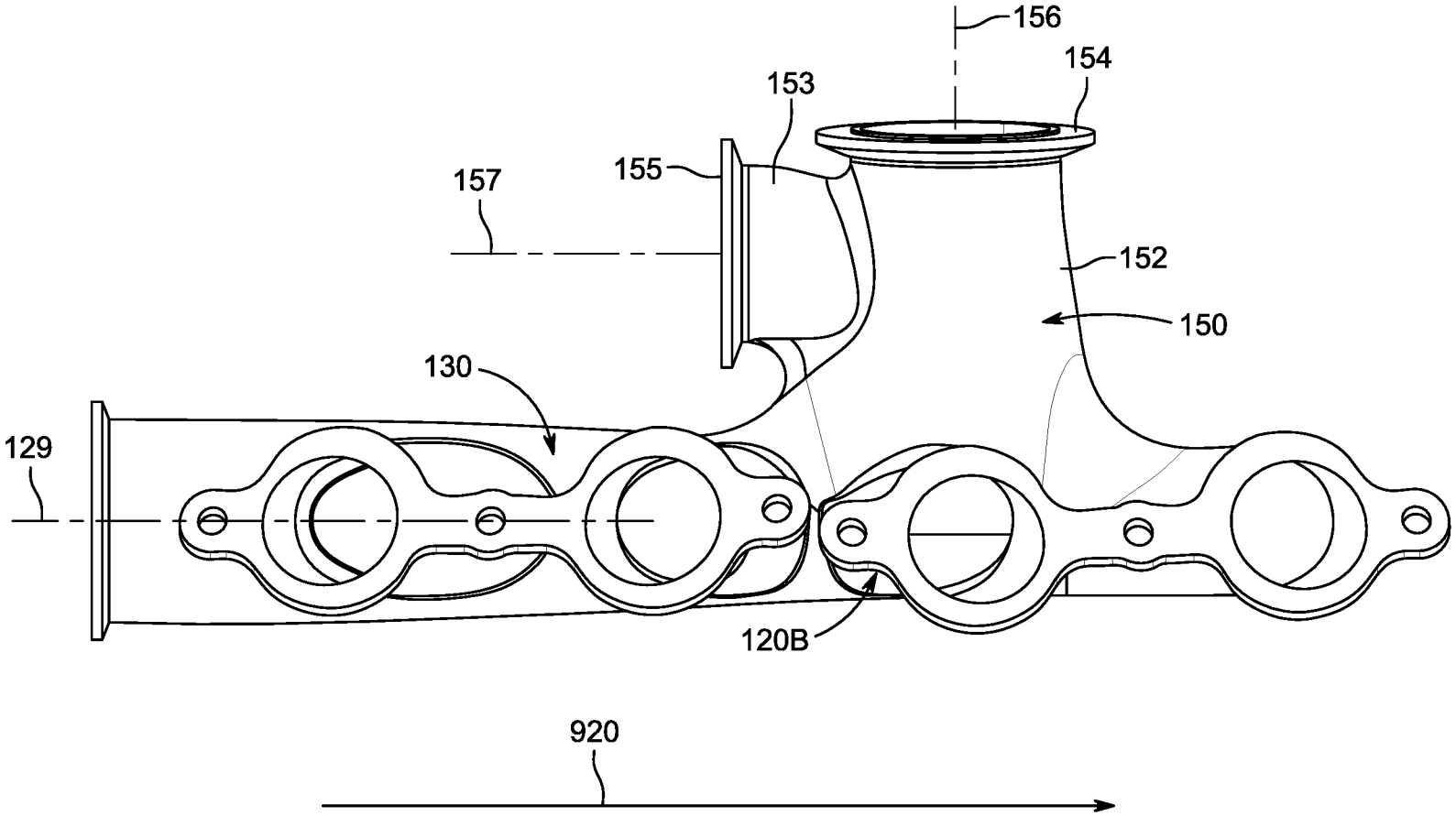
FIG. 4 is a side view of the exhaust manifold of the present invention.

Exhaust gas routing circuit 150 is joined to manifold plenum 130 at a junction between turbocharger support column 152 of gas routing circuit 150 and manifold plenum 130, and extends from manifold plenum 130 in a generally perpendicular direction to axial centerline 129 of plenum 130. The fore-and-aft location of exhaust gas routing circuit 150 on manifold plenum 130 depends on the engine, the amount of space available, the location, size and orientation of the turbocharger and other ancillary components, and like considerations. In the preferred embodiment, which is suitable for an LS3 model 6.2 liter displacement V-8 engine, exhaust gas routing circuit 150 is located toward the forward end of manifold plenum 130 proximate to exhaust stack assembly 120B, as shown for example in FIG. 4.

Figure 3B:
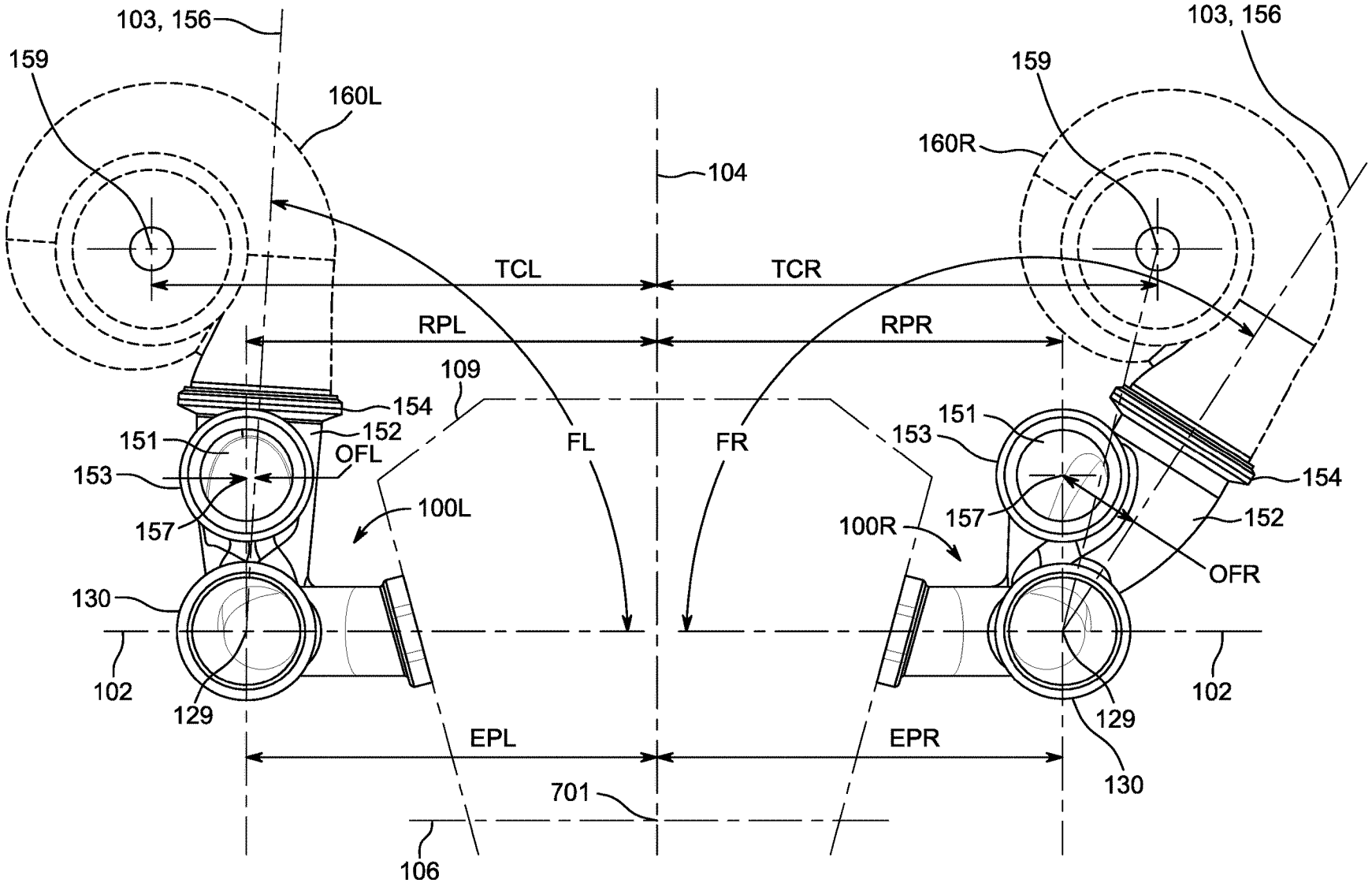
FIG. 3B is a rear view of an exhaust manifold pair of the present invention.

Turbocharger support column 152 in the preferred embodiment is generally circular in cross section about support column centerline 156, depicted in FIGS. 1 and 3. Column centerline 156 in the preferred embodiment is contained in geometrical plane 103, which is shown in FIG. 1 and edge-on in FIG. 3A; plane 103 also contains axial centerline 129 of manifold plenum 130. The angle F subtended by plane 102 and plane 103, shown in FIG. 3A, preferably is determined by considerations such as locating the turbocharger as close to the engine as routing and service access considerations permit, as well as other factors, such as those discussed below in regard to FIG. 3B.

Turbocharger support column 152 preferably has a diameter, thickness and robustness sufficient to hold up and support a desired turbocharger, and resist road-induced stresses and shocks, without the need for additional supporting structures. Accordingly, in the preferred embodiment, support column 152 terminates in a circular mount 154, shown in FIGS. 1, 3A and 4, which is adapted for connection to a turbocharger. For example, circular mount 154 can be configured as a flange so as to have a turbocharger directly mounted to it with suitable clamps. Alternatively, mount 154 can be configured to be connected to hoses or piping to direct exhaust gases to a turbocharger that is distally located from mount 154, in accordance with design preference. It is desirable that the transition between manifold plenum 130 and turbocharger support column 152 be smooth and sufficiently radiused, with no sharp angles or edges, to minimize enthalpy losses associated with exhaust gas flow in the interior exhaust gas passageway to the turbocharger, and also to minimize stress crack generation.

Exhaust gas bypass pipe 153 in the preferred embodiment is generally circular in cross section about its axial centerline 157, depicted in FIG. 1 and end-on in FIG. 3A. It is preferred that exhaust gas bypass pipe 153 be oriented in a generally perpendicular direction from and be secured to support column 152 at a junction forming a T-connection, as shown for example in FIG. 4. The location of bypass pipe 153 on support column 152 is determined based upon such factors as connection routing, service access, and cooperation with related components. In the embodiment shown, exhaust gas bypass pipe 153 is rearwardly oriented, as shown for example in FIG. 4. In one embodiment, the axial centerline 157 of exhaust gas bypass pipe 153 can be located in plane 103. In an alternate embodiment, the axial centerline 157 of exhaust gas bypass pipe 153 can be offset from plane 103 a distance OF, shown in FIGS. 3A, 3B and 5. The design, location and orientation of exhaust gas bypass pipe 153, as shown in the figures and as described above, provides a compact inline, three-tiered nested configuration consisting of the turbocharger, the exhaust bypass valve, and the manifold plenum 130.

In FIG. 1, exhaust gas bypass pipe 153 terminates in a turbine bypass outlet 151 having a circular mount 155, which is adapted for connection to an exhaust bypass valve. For example, circular mount 155 can be configured as a flange on which can be directly mounted an exhaust bypass valve with suitable clamps. The provision of exhaust gas bypass pipe 153 yields a number of engine configuration options, such as for example more easily permitting use of different types and/or models of bypass valves over time, or locating the bypass valve remotely from the turbocharger, in accordance with preference. Should a turbocharger with an integral bypass be utilized, mount 155 can be capped and sealed off.

Turbocharger support column 152 of exhaust gas routing circuit 150 can be joined to manifold plenum 130 via welding, brazing or by being integrally formed with manifold plenum 130. Exhaust gas bypass pipe 153 of exhaust gas routing circuit 150 can be joined to turbocharger support column 152 in like manner. It is preferred that exhaust gas routing circuit 150 be integrally formed with manifold plenum 130, as by casting.

Embodiments Having Left and Right Exhaust Manifolds Design Differences

Figure 5:
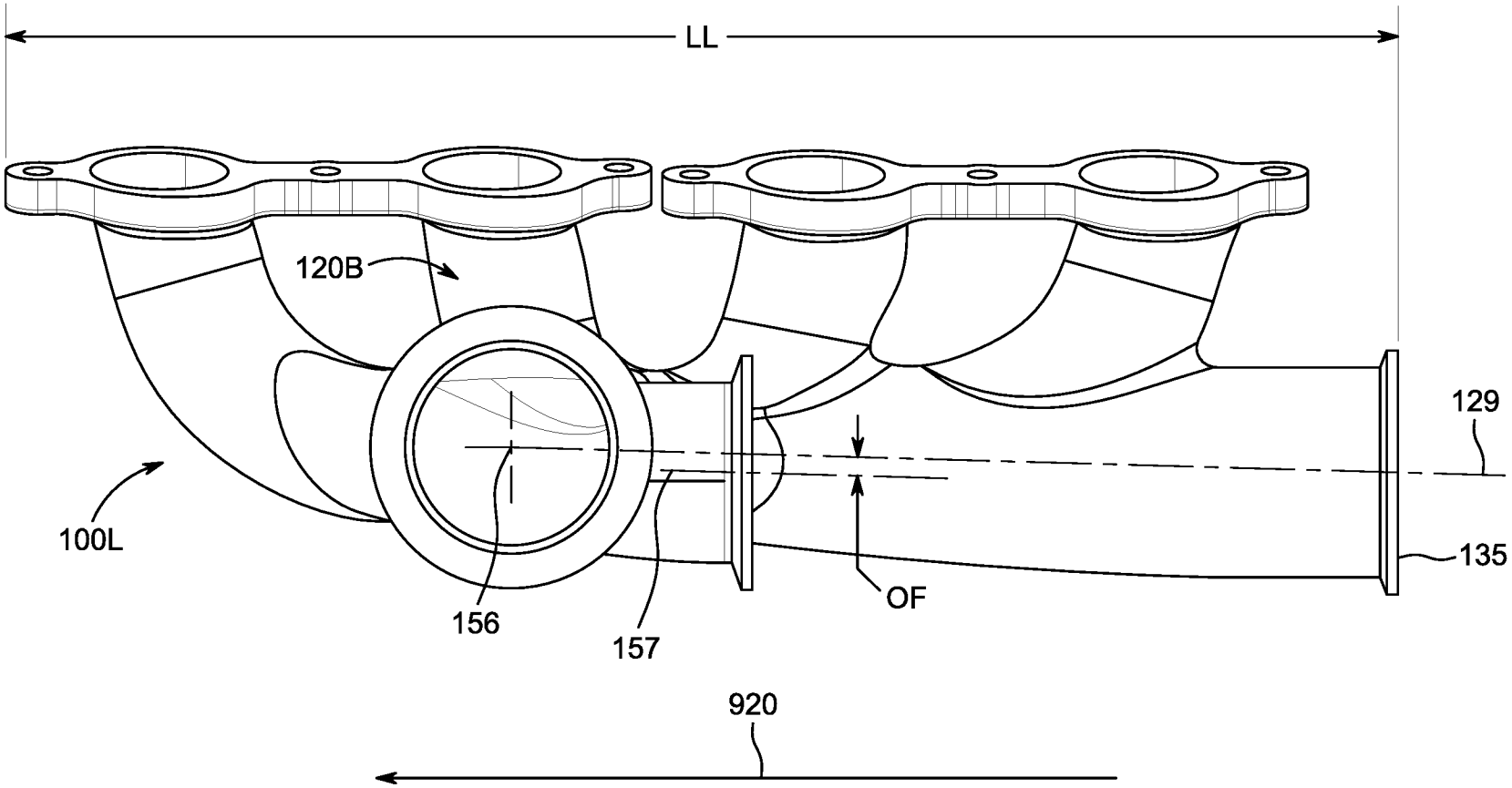
FIG. 5 is a top view of the exhaust manifold of the present invention.

The overall length of left exhaust manifold 100L, denominated LL, is shown in FIG. 5. In one embodiment, the length LL is the same as length LR, which is the length of the right exhaust manifold 100R (not shown in FIG. 5). If the exhaust manifolds 100L and 100R of that embodiment are utilized with a V-8 engine, such as an LS3 model 6.2 liter displacement V-8 engine, the rearward ends of each manifold (end 135 shown in FIG. 1) generally will not be on a line orthogonal to plane 104, the vertical plane passing through crankshaft centerline 701 and equidistant from the cylinder banks. This is because the exhaust discharge ports of one cylinder bank in V-8 engines typically are offset ahead or behind the discharge ports of the other cylinder bank.

Thus in an alternative embodiment, LL of manifold 100L is not the same length as LR of manifold 100R, but rather one or both of LL and LR are adjusted in length an amount equal to the offset distance between the V-8 engine's left and right cylinder bank discharge ports, so as to result in the rearward ends 135 of each manifold plenum 130 of the exhaust manifolds (100L and 100R) terminating approximately at the same distance behind the engine ("Relationship A"); i.e., both lying approximately in the same vertical plane, transversely oriented to plane 104 (i.e., both lying in a vertical plane having an orthogonal relationship with the engine crankshaft centerline). For example, for a left-bank forward V-8, LL will be larger than LR by an amount approximately equal to the cylinder bank offset distance. Terminating each manifold on the same plane transversely oriented to plane 104 also facilitates utilizing the exhaust manifolds 100L and 100R in a reversed orientation, i.e., rotated 180 degrees about a vertical center axis of the engine, such that exhaust gas passageway 140 of each exhaust manifold 100L, 100R is proximate to the front of the engine.

In one type of turbocharger design, the exhaust gas intake to the turbine is in the shape of a spiral, which generally results in the turbocharger being radially asymmetric about the turbocharger axis (non-axisymmetric). In one embodiment of the present invention, the values of angle F and offset OF are the same for exhaust manifolds 100L and 100R. That embodiment is particularly adapted to the utilization of turbocharger pairs which rotate in opposite directions and whose exhaust gas intakes and outlets are mirror imaged in design. In that embodiment, even if the turbochargers are asymmetric as described above, the overall arrangement of exhaust manifolds 100L and 100R and their associated turbochargers will be symmetric about the vertical plane 104 of the engine.

In another embodiment of the present invention, the values of angle F and offset OF are not the same for exhaust manifolds 100L and 100R, but rather differ. In the case where two turbochargers are used, this embodiment is particularly adapted for the situation where the same turbocharger design (of asymmetric shape, each rotating in the same direction) is used with exhaust manifolds 100L and 100R. This embodiment is depicted in FIG. 3B, which shows exhaust manifolds 100L and 100R connected to a schematically depicted engine 109, divided by vertical plane 104. Among other things, FIG. 3B shows a turbocharger 160L mounted on circular mount 154 of exhaust manifold 100L, and a turbocharger 160R mounted on circular mount 154 of exhaust manifold 100R, with the centerlines 159 of turbochargers 160L, 160R oriented generally parallel to plane 104. In this embodiment, it is preferred that the angular relationships and dimensions relating to exhaust gas routing circuit 150 be appropriately adjusted for each of exhaust manifolds 100L and 100R such that when turbochargers 160L and 160R are respectively mounted on circular mounts 154 of support columns 152 of exhaust manifold 100L and 100R: the distance TCL from the centerline 159 of turbocharger 160L to plane 104 is approximately the same as the distance TCR from the centerline 159 of turbocharger 160R to plane 104 ("Relationship B"); and the centerline 159 of turbocharger 160L lies in approximately the same horizontal plane as the centerline 159 of turbocharger 160R ("Relationship C").

As an example, in FIG. 3B the angle FL subtended by plane 102 and plane 103 of exhaust manifold 100L, and the angle FR subtended by plane 102 and plane 103 of exhaust manifold 100R, are each adjusted such that when the turbochargers (denominated 160L and 160R in FIG. 3B) are respectively mounted on support columns 152 of exhaust manifolds 100L and 100R, the distance TCL from the centerline 159 of turbocharge 160L to plane 104 is approximately the same as the distance TCR from the centerline 159 of turbocharge 160R to plane 104.

It is additionally preferred that the foregoing angular relationships and dimensions be appropriately adjusted such that: the distance RPL from the centerline 157 of bypass pipe 153 of exhaust manifold 100L to plane 104 is approximately the same as the distance RPR from the centerline 157 of bypass pipe 153 of exhaust manifold 100R to plane 104 ("Relationship D"); and the centerline 157 of bypass pipe 153 of exhaust manifold 100L lie in approximately the same horizontal plane as the centerline 157 of bypass pipe 153 of exhaust manifold 100R ("Relationship E").

As an example, in FIG. 3B the axial centerline 157 of exhaust gas bypass pipe 153 of exhaust manifold 100L is offset from 100L's plane 103 a distance OFL, and the axial centerline 157 of exhaust gas bypass pipe 153 of exhaust manifold 100R is offset from 100R's plane 103 a distance OFR, such that the distance RPL from the centerline 157 of bypass pipe 153 of manifold 100L to plane 104 is approximately the same as the distance RPR from the centerline 157 of bypass pipe 153 of manifold 100R to plane 104.

Otherwise, except as discussed above in connection with Relationships A-E, the components of exhaust manifolds 100L and 100R as relevant here mirror each other (e.g., dimensions and orientations of exhaust stack assemblies 120, manifold plenums 130, locations of exhaust gas routing circuits 150 on manifold plenums 130). This mirrored relationship results in: the distance EPL between centerline 129 of manifold plenum 130 of exhaust manifold 100L and vertical plane 104 of engine 109 being approximately the same as the distance EPR between centerline 129 of manifold plenum 130 of exhaust manifold 100R and vertical plane 104 of engine 109 ("Relationship F"); and centerline 129 of manifold plenum 130 of exhaust manifold 100L lying in approximately the same horizontal plane as the centerline 129 of manifold plenum 130 of exhaust manifold 100R ("Relationship G"). This mirrored relationship further results in: the centerline 156 of support column 152 of exhaust manifold 100L lying approximately in the same vertical plane, transversely oriented to plane 104 (i.e., having an orthogonal relationship with crankshaft centerline 701), as the centerline 156 of support column 152 of exhaust manifold 100R ("Relationship H"); and turbine bypass outlet 151 of exhaust gas bypass pipe 153 of exhaust manifold 100L lying approximately in the same vertical plane, transversely oriented to plane 104, as the turbine bypass outlet 151 of exhaust gas bypass pipe 153 of exhaust manifold 100R ("Relationship I").

The foregoing Relationships A-I are preferred in the embodiment shown in FIG. 3B to make easier connecting the elements of exhaust manifolds 100L, 100R, as well as the turbochargers 160L and 160R, with other components that are symmetrically arranged about vertical plane 104 and/or the vehicle centerline. In a particular embodiment as shown in FIG. 3B suitable for use with an LS3 model 6.2 liter displacement V-8 engine, angle FL is less than the angle FR, angle FL is about 86 degrees and angle FR is about 121.5 degrees. In addition, in the same embodiment the offset OFL is less than the offset OFR, offset OFL is about 0.22 inch and offset OFR is about 1.91 inches.

Although described with reference for use with a V-8 engine, the present invention has more general application, and can be utilized with any internal combustion piston engine having a row of two or more cylinders inclined from the vertical at an acute angle of approximately 45° or less, such as in-line inclined four, five and six cylinder engines, as well as V-4 engines, V-6 engines, V-12 engines, V-16 engines, etc. Manifold designs generally in accordance with the embodiment of exhaust manifold 100 disclosed herein are utilizable in some of the engine configurations disclosed in U.S. Provisional Patent Application No. 62/697,072 entitled "Customizable Engine Air Intake/Exhaust Systems" and filed Jul. 12, 2018, and in U.S. patent application Ser. No. 16/168,984 entitled "Customizable Engine Air Intake/Exhaust Systems," having the same inventors as the subject application and filed on the same date as the subject application.

As is more particularly disclosed in that provisional application and that utility patent application, an exhaust manifold having a design generally corresponding to exhaust manifold 100 herein can be paired with a second exhaust manifold of like design, or can be paired with an exhaust manifold following the design disclosed in U.S. Provisional Application No. 62/598,045, entitled "Dual-Angle Exhaust Manifold," filed Dec. 13, 2017, according to the particular engine configuration, and disclosed in U.S. patent application Ser. No. 16/168,971 entitled "Dual-Angle Exhaust Manifold," having the same inventors as the subject application and filed on the same date as the subject application, again according to the particular engine configuration. The contents of U.S. Provisional Application No. 62/697,072 are hereby incorporated by reference as if fully disclosed herein. The contents of U.S. patent application Ser. No. 16/168,984 entitled "Customizable Engine Air Intake/Exhaust Systems," having the same inventors as the subject application and filed on the same date as the subject application, are hereby incorporated by reference as if fully set forth herein including, as disclosed therein, the exhaust manifold design generally corresponding to exhaust manifold 100, and the different engine configurations and components disclosed therein utilizing or functioning in conjunction with such exhaust manifold, found for example at paragraphs 53-70, 72-73, 75-108, 110-154, 156-173, 175-192, 194-197 and FIGS. 2-34. The contents of U.S. Provisional Application No. 62/598,045 are hereby incorporated by reference as if fully set forth herein, including the design of the exhaust manifold described therein. The contents of U.S. patent application Ser. No. 16/168,971 entitled "Dual-Angle Exhaust Manifold," having the same inventors as the subject application and filed on the same date as the subject application, are incorporated by reference as if fully set forth herein, including as disclosed therein, the aforementioned manifold design that can be paired with an exhaust manifold having a design generally corresponding to exhaust manifold 100, found for example at paragraphs 12-20 and FIGS. 1-3 thereof.

The foregoing detailed description is for illustration only and is not to be deemed as limiting the inventions, which are defined in the appended claims.

What is claimed is:

1. An exhaust manifold for an internal combustion piston engine having a first row of at least two cylinders inclined relative to a vertical plane, a second row of at least two cylinders inclined relative to the vertical plane, the two rows of cylinders forming a V configuration with the vertical plane being approximately equidistant between the two rows, the exhaust manifold comprising:

plural exhaust stack assemblies for receiving exhaust gas from the first row of cylinders;

an elongate manifold plenum having a terminal portion defining an exhaust gas passageway;

an exhaust gas routing circuit joined to the manifold plenum, the routing circuit comprising a turbocharger support column and a bypass pipe;

the turbocharger support column joined at a first junction with the manifold plenum, extending in a generally perpendicular direction from the elongate manifold plenum and terminating in a first exhaust gas outlet adapted for connection to a turbocharger;

the bypass pipe joined at a second junction with the support column and terminating in a second exhaust gas outlet adapted for connection to an exhaust bypass relief valve;

each of the plural exhaust stack assemblies comprising a leader pipe and an exhaust connector, a first end of each leader pipe joined to a first end of the exhaust connector of the exhaust stack assembly, a second end of each exhaust connector joined to the manifold plenum; and a second end of each leader pipe joined to a manifold flange, the manifold flange adapted for joining to the internal combustion engine to receive exhaust gases from the first row of cylinders of the engine.

2. An exhaust manifold as in claim 1, wherein the elongate manifold plenum has a forward end distal from the terminal portion of the manifold plenum, and the second end of the exhaust connector of a first exhaust stack assembly of the plural exhaust stack assemblies is joined to the manifold plenum at the forward end, and the exhaust connector of the first exhaust stack assembly is a curved pipe of relatively uniform diameter.

3. An exhaust manifold as in claim 2, wherein the diameter of the exhaust connector of each of the other or others of the plural exhaust stack assemblies increases from the first end of the exhaust connector to the second end of the exhaust connector.

4. An exhaust manifold as in claim 1, where the bypass pipe extends in a generally perpendicular direction from the turbocharger support column.

5. An exhaust manifold as in claim 4, where the bypass pipe has a centerline, the elongate manifold plenum has a centerline and the bypass pipe is oriented so that the bypass pipe centerline is generally parallel to the manifold plenum centerline.

6. An exhaust manifold for an internal combustion piston engine having a first row of at least two cylinders inclined relative to a vertical plane, a second row of at least two cylinders inclined relative to the vertical plane, the two rows of cylinders forming a V configuration with the vertical plane being approximately equidistant between the two rows, the exhaust manifold comprising:

plural exhaust stack assemblies for receiving exhaust gas from the first row of cylinders;

an elongate manifold plenum having a terminal portion defining an exhaust gas passageway;

an exhaust gas routing circuit joined to the manifold plenum, the routing circuit comprising a turbocharger support column and a bypass pipe;

the turbocharger support column joined at a first junction with the manifold plenum, extending in a generally perpendicular direction from the elongate manifold plenum and terminating in a first exhaust gas outlet adapted for connection to a turbocharger;

the bypass pipe joined at a second junction with the support column and terminating in a second exhaust gas outlet adapted for connection to an exhaust bypass valve;

each of the plural exhaust stack assemblies comprising a leader pipe and an exhaust connector, a first end of each leader pipe joined to a first end of the exhaust connector of the exhaust stack assembly, a second end of each exhaust connector joined to the manifold plenum;

a second end of each leader pipe joined to a manifold flange, the manifold flange adapted for joining to the internal combustion engine to receive exhaust gases from the first row of cylinders of the engine; and each leader pipe oriented toward the first junction of the support column with the manifold plenum.

7. An exhaust manifold as in claim 6, wherein the elongate manifold plenum has a forward end distal from the terminal portion of the manifold plenum, and the second end of the exhaust connector of a first exhaust stack assembly of the plural exhaust stack assemblies is joined to the manifold plenum at the forward end, and the exhaust connector of the first exhaust stack assembly is a curved pipe of relatively uniform diameter.

8. An exhaust manifold as in claim 7, wherein the diameter of the exhaust connector of each of the other or others of the plural exhaust stack assemblies increases from the first end of the exhaust connector to the second end of the exhaust connector.

9. An exhaust manifold as in claim 6, where the bypass pipe extends in a generally perpendicular direction from the turbocharger support column.

10. An exhaust manifold as in claim 9, where the bypass pipe has a centerline, the elongate manifold plenum has a centerline and the bypass pipe is oriented so that the bypass pipe centerline is generally parallel to the manifold plenum centerline.

11. An exhaust manifold for an internal combustion piston engine having a first row of at least two cylinders inclined relative to a vertical plane, a second row of at least two cylinders inclined relative to the vertical plane, the two rows of cylinders forming a V configuration with the vertical plane being approximately equidistant between the two rows, the exhaust manifold comprising:

plural exhaust stack assemblies for receiving exhaust gas from the first row of cylinders;

an elongate manifold plenum having a terminal portion defining an exhaust gas passageway;

an exhaust gas routing circuit joined to the manifold plenum, the routing circuit comprising a turbocharger support column and an bypass pipe;

the turbocharger support column joined at a first junction with the manifold plenum, extending in a generally perpendicular direction from the elongate manifold plenum and terminating in a first exhaust gas outlet adapted for connection to a turbocharger;

the bypass pipe joined at a second junction with the support column and terminating in a second exhaust gas outlet adapted for connection to an exhaust bypass valve;

each of the plural exhaust stack assemblies comprising a leader pipe and an exhaust connector, a first end of each leader pipe joined to a first end of the exhaust connector of the exhaust stack assembly, a second end of each exhaust connector joined to the manifold plenum;

a second end of each leader pipe joined to a manifold flange, the manifold flange adapted for joining to the internal combustion engine to receive exhaust gases from the first row of cylinders of the engine;

each leader pipe joined to the manifold flange at a first angle in a vertical plane so that the plural exhaust stack assemblies are approximately horizontally oriented when joined to the internal combustion piston engine; and each leader pipe oriented in a horizontal plane toward the first junction of the support column with the manifold plenum.

12. An exhaust manifold as in claim 11, wherein the elongate manifold plenum has a forward end distal from the terminal portion of the manifold plenum, and the second end of the exhaust connector of a first exhaust stack assembly of the plural exhaust stack assemblies is joined to the manifold plenum at the forward end, and the exhaust connector of the first exhaust stack assembly is a curved pipe of relatively uniform diameter.

13. An exhaust manifold as in claim 12, wherein the diameter of the exhaust connector of each of the other or others of the plural exhaust stack assemblies increases from the first end of the exhaust connector to the second end of the exhaust connector.

14. An exhaust manifold as in claim 11, where the bypass pipe extends in a generally perpendicular direction from the turbocharger support column.

15. An exhaust manifold as in claim 14, where the bypass pipe has a centerline, the elongate manifold plenum has a centerline and the bypass pipe is oriented so that the bypass pipe centerline is generally parallel to the manifold plenum centerline.

16. A pair of exhaust manifolds for an internal combustion piston engine having a front and a rear, and comprising a crankshaft having a centerline, a first row of at least two cylinders inclined relative to a first vertical plane containing the crankshaft centerline, the first row of cylinders having discharge ports, a second row of at least two cylinders inclined relative to the first vertical plane, the second row of cylinders having discharge ports, the two rows of cylinders forming a V configuration with the first vertical plane being approximately equidistant between the two rows and being approximately perpendicular to a first horizontal plane containing the crankshaft centerline, the discharge ports of the first row of cylinders being offset an offset distance relative to the front or the rear of the respective discharge ports of the second set of cylinders, the pair of exhaust manifolds comprising:

(1) a first exhaust manifold adapted to be joined to the discharge ports of the first row of cylinders of the engine, the first exhaust manifold including (a) a first set of plural exhaust stack assemblies adapted for joining to the discharge ports of the first row of cylinders to receive exhaust gases from the first row of cylinders; (b) a first manifold plenum joined to the to the first set of plural exhaust stack assemblies and having a terminal portion defining a first exhaust gas passageway and a forward end distal from the terminal portion, the distance between the terminal portion and the forward end defining a first length; (c) a first exhaust gas routing circuit joined to the first manifold plenum, the first exhaust gas routing circuit comprising a first turbocharger support column and a first bypass pipe; the first turbocharger support column joined with the first manifold plenum and terminating in a first exhaust gas outlet adapted for receiving a turbocharger mounted thereon; the first bypass pipe joined with the first turbocharger support column and terminating in a second exhaust gas outlet adapted for connection to an exhaust bypass relief valve; (d) a first exhaust stack assembly of the first set of plural exhaust stack assemblies of the first exhaust manifold having a second length and joined to the first manifold plenum at the forward end; and (e) the first and second lengths defining the overall length of the first exhaust manifold;

(2) a second exhaust manifold adapted to be joined to the discharge ports of the second row of cylinders of the engine, the second exhaust manifold including (a) a second set of plural exhaust stack assemblies adapted for joining to the discharge ports of the second row of cylinders to receive exhaust gases from the second row of cylinders; (b) a second manifold plenum joined to the second set of plural exhaust stack assemblies and having a terminal portion defining a second exhaust gas passageway and a forward end distal from the terminal portion, the distance between the terminal portion and the forward end defining a third length; (c) a second exhaust gas routing circuit joined to the second manifold plenum, the second exhaust gas routing circuit comprising a second turbocharger support column and a second bypass pipe; the second turbocharger support column joined with the second manifold plenum and terminating in a third exhaust gas outlet adapted for receiving a turbocharger mounted thereon; the second bypass pipe joined with the second support column and terminating in a fourth exhaust gas outlet adapted for connection to an exhaust bypass relief valve; (d) a second exhaust stack assembly of the second set of plural exhaust stack assemblies of the second exhaust manifold having a fourth length and joined to the second manifold plenum at the forward end; and (f) the third and fourth lengths defining the overall length of the second exhaust manifold; and (3) one or more of the first, second, third and fourth lengths being adjusted in dimension so that the terminal portion of the manifold plenum of the first exhaust manifold and the terminal portion of the manifold plenum of the second exhaust manifold are located approximately on a second vertical plane orthogonal to the crankshaft centerline when the first and second manifolds are joined to the discharge ports of the engine.

17. The pair of exhaust manifolds as in claim 16, wherein the first bypass pipe and the second bypass pipe are positioned to be rearwardly oriented when the first and second manifolds are joined to the discharge ports of the engine.

18. The pair of exhaust manifolds as in claim 17, wherein the first bypass pipe has a first pipe centerline, the second bypass pipe has a second pipe centerline, and the first bypass pipe and the second bypass pipes are respectively positioned on the first and second manifolds so that the first pipe centerline and the second pipe centerline are approximately equidistant from the first vertical plane when the first and second manifolds are joined to the discharge ports of the engine.

19. The pair of exhaust manifolds as in claim 18, wherein the first bypass pipe and the second bypass pipe are respectively positioned on the first and second manifolds so that both the first pipe centerline and the second pipe centerline are located approximately in a second horizontal plane when the first and second manifolds are joined to the discharge ports of the engine.

20. The pair of exhaust manifolds as in claim 16, wherein the second and fourth exhaust gas outlets are respectively positioned on the first and second manifolds so that they are located approximately on a third vertical plane, orthogonal to the crankshaft centerline, when the first and second manifolds are joined to the discharge ports of the engine.

21. The pair of exhaust manifolds as in claim 16, wherein the first turbocharger support column has a first column centerline and the second turbocharger support column has a second column centerline, and the first turbocharger support column and the second turbocharger support column are respectively positioned on the first and second manifolds so that the first column centerline and the second column centerline are located approximately in a fourth vertical plane, orthogonal to the crankshaft centerline, when the first and second manifolds are joined to the discharge ports of the engine.

22. The pair of exhaust manifolds as in claim 16, wherein the first manifold plenum has a first passage centerline, the second manifold plenum has a second passage centerline, and the first exhaust manifold and the second exhaust manifold are configured so that the first and second passage centerlines are approximately equidistant from the first vertical plane when the first and second manifolds are joined to the discharge ports of the engine.

23. The pair of exhaust manifolds as in claim 22, wherein the first exhaust manifold and the second exhaust manifold are configured so that the first and second passage centerlines are located approximately in a third horizontal plane when the first and second manifolds are joined to the discharge ports of the engine.

24. The pair of exhaust manifolds as in claim 16, wherein (a) the first gas outlet is adapted for having mounted thereon a first select asymmetric turbocharger having a centerline to be oriented approximately parallel to the first vertical plane when the first manifold is joined to the discharge ports of the first row of cylinders of the engine, (b) the third gas outlet is adapted for having mounted thereon a second select asymmetric turbocharger, of the same general design as the first select asymmetric turbocharger, having a centerline to be oriented approximately parallel to the first vertical plane when the second manifold is joined to the discharge ports of the second row of cylinders of the engine, and (c) the first gas outlet and the third gas outlet are positioned on the first and second manifolds respectively so that the centerlines of the first and second select asymmetric turbochargers are approximately equidistant from the first vertical plane when the first and second manifolds are joined to the discharge ports of the engine and the first and second select asymmetric turbochargers are respectively mounted to the first and third gas outlets of the first and second manifolds.

25. The pair of exhaust manifolds as in claim 16, wherein (a) the first gas outlet is adapted for having mounted thereon a first select asymmetric turbocharger having a centerline to be oriented approximately parallel to the first vertical plane when the first manifold is joined to the discharge ports of the first row of cylinders of the engine, (b) the third gas outlet is adapted for having mounted thereon a second select asymmetric turbocharger, of the same general design as the first select asymmetric turbocharger, having a centerline to be oriented approximately parallel to the first vertical plane when the second manifold is joined to the discharge ports of the second row of cylinders of the engine, and (c) the first gas outlet and the third gas outlet are positioned on the first and second manifolds respectively so that the centerlines of the first and second select asymmetric turbochargers are located approximately in a fourth horizontal plane when the first and second manifolds are joined to the discharge ports of the engine and the first and second select asymmetric turbochargers are respectively mounted to the first and third gas outlets of the first and second manifolds.

* * * * *